US008205588B2

(12) United States Patent
Nakashima et al.

(10) Patent No.: US 8,205,588 B2
(45) Date of Patent: Jun. 26, 2012

(54) VARIABLE VALVE-ACTUATING MECHANISM FOR AN INTERNAL COMBUSTION ENGINE, AND ENGINE INCORPORATING SAME

(75) Inventors: Masahiro Nakashima, Saitama (JP); Katsuhiro Kubo, Saitama (JP); Yoshihiro Takada, Saitama (JP); Takuya Warashina, Saitama (JP); Kazuyuki Kosei, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 300 days.

(21) Appl. No.: 12/721,703

(22) Filed: Mar. 11, 2010

(65) Prior Publication Data

US 2010/0242874 A1 Sep. 30, 2010

(30) Foreign Application Priority Data

Mar. 26, 2009 (JP) ..... 2009-075502
Jan. 15, 2010 (JP) ..... 2010-007462

(51) Int. Cl.
*F01L 1/18* (2006.01)

(52) U.S. Cl. ..... 123/90.39; 123/90.44; 123/90.16; 74/559; 74/569

(58) Field of Classification Search ..... 123/90.16, 123/90.39, 90.44; 74/559, 567, 569
See application file for complete search history.

(56) References Cited

U.S. PATENT DOCUMENTS 7,980,213 B2 * 7/2011 Warashina et al. ..... 123/90.16

FOREIGN PATENT DOCUMENTS

JP Sho 62-711 1/1987

* cited by examiner

*Primary Examiner* — Ching Chang
(74) *Attorney, Agent, or Firm* — Carrier Blackman & Associates, P.C.; William D. Blackman; Joseph P. Carrier

(57) ABSTRACT

In an internal combustion engine, a variable valve-actuating mechanism includes a trigger pin operable to permit axial movement of a rocker arm concurrently with a axial movement of a rocker arm shaft. A retention member has an insertion aperture formed therein, in which the trigger pin is inserted, and which slidably supports the trigger pin in the inserting direction. The trigger pin includes upper and lower expanded portions disposed on both sides thereof in the inserting direction. The upper and lower expanded portions of the trigger pin are operable to disable sliding motion of the trigger pin, relative to the retention member, beyond a predetermined range. The upper and lower expanded portions allow the trigger pin to be integrally assembled in the insertion aperture of the retention member, so as to be selectively retained therein.

19 Claims, 9 Drawing Sheets

VARIABLE VALVE-ACTUATING MECHANISM FOR AN INTERNAL COMBUSTION ENGINE, AND ENGINE INCORPORATING SAME

CROSS-REFERENCE TO RELATED APPLICATIONS

The present invention claims priority under 35 USC 119 based (1) on Japanese patent application No. 2009-075502, filed on Mar. 26, 2009, and (2) on Japanese patent application No. 2010-007462, filed on Jan. 15, 2010. The entire subject matter of each of these priority documents, including specification claims and drawings, are incorporated by reference herein.

BACKGROUND OF THE INVENTION

1. Field of the Invention

The present invention relates to a variable valve-actuating mechanism for an internal combustion engine, and to an engine incorporating the valve-actuating mechanism. More particularly, the present invention relates to a variable valve-actuating mechanism including an unlocking mechanism, integrally assembled in a retention member, for selectively releasing a locking structure for a rocker arm, and to an internal combustion engine incorporating the described valve -actuating mechanism.

2. Description of the Background Art

One known variable valve-actuating mechanism includes a rocker arm, disposed between an engine valve and a corresponding cam on an intake-side or an exhaust-side of an internal combustion engine, and first and second cams relative to the engine valve. A rocker arm shaft which pivotally supports the rocker arm is axially movable along an axial direction thereof, with the rocker arm axially sliding along with the rocker arm shaft according to the axial movement thereof, thereby allowing the rocker arm to selectively engage either a first cam or a second cam to change operation of the engine valve (see, for example, Japanese Utility Model Laid-open No. Sho 62-711 (JP '711)). The known mechanism further includes a release member which, in order to let the rocker arm slide in time with a rotation timing of a camshaft, unlocks a lock mechanism for temporarily holding the rocker arm in place, in time with a predetermined rotation timing of the camshaft.

In the variable valve-actuating member of JP '711 as described above, the release member is inserted in a retention member in a journal bearing, and is capable of making a reciprocating motion by having an end portion in a sliding contact with a cam surface of the camshaft. The release member is, however, held in position simply by being clamped between the retention member and the camshaft, and has no fixing structure relative to the retention member.

When such a known subassembly, including the release member inserted in the retention member, is to be mounted on the camshaft, the release member can fairly easily slip out of position. Thus, such a subassembly may not always be adequately assembled to an engine main body, or extra assembly time, effort and expense may be required to manually re-insert the release member into the retention member, in instances where it has slipped out of position.

The present invention has been made to overcome such drawbacks of the existing variable valve-actuating mechanism. Accordingly, it is one of the objects of the present invention to provide a variable valve-actuating mechanism having an unlocking mechanism which is integrally assembled with a retention member, in which structure is provided to enable improved retention of the release member in the retention member, thereby achieving a more efficient assembly process.

SUMMARY OF THE INVENTION

In order to achieve the above object, a first aspect and feature of the present invention provides a variable valve-actuating mechanism having a rocker arm disposed between an engine valve and a corresponding cam on an intake-side or an exhaust-side of an internal combustion engine, and a rocker arm shaft which pivotally supports the rocker arm and is axially movable along an axial direction, the rocker arm axially slidable along with the rocker arm shaft according to an axial movement thereof, thereby allowing the rocker arm to selectively engage either a first or second cam, to change operation of the engine valve.

The variable valve-actuating mechanism according to the first aspect hereof further includes a stopper member which engages the rocker arm to restrict an axial movement of the rocker arm; a release member which releases engagement of the stopper member so as to effect the axial movement of the rocker arm at a predetermined time; and a retention member having an insertion aperture in which the release member is to be inserted and which slidably supports the release member when inserted. The release member includes a movement-restricting device disposed on both sides in the inserting direction, the movement-restricting device disabling the sliding motion of the release member when a predetermined range is exceeded relative to the retention member. Further, the movement-restricting device allows the release member to be integrally assembled in the retention member so as to retain the release member in the insertion aperture.

The present invention according to a second aspect and feature thereof, the insertion aperture includes a circular hole portion to be used during assembly of the release member and a slot portion which allows the release member to be moved in the axial direction and which holds the release member after the release member is inserted in the circular hole portion; the circular hole portion having an inside diameter that is larger than a short side dimension of the slot portion extending orthogonally to the axial direction; the movement-restricting device includes a protrusion portion protruding in a direction orthogonal to the axial direction when inserted in the insertion aperture; and the protrusion portion has a width in the protruding direction that can pass through the circular hole portion and is larger than the short side dimension of the slot portion.

The present invention according to a third aspect and feature thereof, the release member moves along the slot portion in the axial direction during operation of the variable valve-actuating mechanism; and the circular hole portion is disposed outside the slot portion in the axial direction and outside a range of movement of the release member in the axial direction during the operation of the variable valve-actuating mechanism.

The present invention according to a fourth aspect and feature thereof, the release member has a first movement-restricting device which includes an expanded portion, of which a relatively large portion protrudes when compared to the inserted portion, and a second movement-restricting device which includes a small protrusion portion, of which a relatively small portion protrudes, disposed on both sides of the release member in the inserting direction; and the first movement-restricting device has a width in a direction orthogonal to the axial direction larger than the inside diameter of the circular hole portion.

The present invention according to a fifth aspect and feature thereof, the expanded portion is disposed so as to be continuous with an abutment portion which abuts the stopper member when engagement of the stopper member is to be released.

The present invention according to a sixth aspect and feature thereof, a portion of the protrusion portion of the release member facing a corner portion of the insertion aperture includes an escape portion inhibiting contact with the corner portion.

The present invention according to a seventh aspect and feature thereof, the escape portion is formed into a concave shape to avoid a bun being formed at the corner portion of the insertion aperture.

The present invention according to a eighth aspect and feature thereof, the release member is formed in a mold and the escape portion is integrally formed during molding thereof.

According to the first aspect and feature of the present invention, the release member includes the movement-restricting device disposed on both sides in the inserting direction relative to the retention member and the release member is relatively movable only in the predetermined range relative to the retention member. This allows the release member to be integrally assembled in the retention member so as to be prevented from slipping out of position. As a result, in a subassembly that integrally assembles together the rocker arm shaft, the rocker arm, the release member, and the retention member, there is no likelihood that the release member will slip out of the retention member, achieving a more efficient assembly method of the subassembly in an engine main body.

According to the second aspect and feature of the present invention, the release member can be inserted into the insertion aperture by using the circular hole portion and, after the release member is inserted in the insertion aperture, the release member is moved into the slot portion, which causes the movement-restricting device to be caught by an edge of an opening of the slot portion, such that the release member can be locked in position. The release member can therefore be integrally assembled in the retention member using a simple structure.

According to the third aspect and feature of the present invention, the circular hole portion for assembling the release member is disposed at a position outside the range of movement of the release member during the operation of the variable valve-actuating mechanism. The release member will therefore never reach the circular hole portion during the operation of the variable valve-actuating mechanism, so that the release member can be inhibited from, for example, being shaky, and reliable operation can be maintained.

According to the fourth aspect and feature of the present invention, when the release member is inserted in the circular hole portion with the second movement-restricting device first in order to assemble the release member using the circular hole portion, there is no likelihood that the release member will slip out of position through the circular hole portion. A more efficient assembly method of the subassembly can therefore be achieved.

According to the fifth aspect and feature of the present invention, the expanded portion is disposed so as to be continuous with the abutment portion that abuts on the stopper member, thereby forming a structure that lets the abutment portion and the expanded portion reinforce each other.

According to the sixth aspect and feature of the present invention, a possible contact between the release member and the corner portion of the insertion aperture is prevented to ensure smooth axial movements of the release member and to inhibit wear.

According to the seventh aspect and feature of the present invention, contact of the release member with the bun is prevented to thereby ensure smooth motion.

According to the eighth aspect and feature of the present invention, as compared with a case in which the corner portion of the insertion aperture is subjected to, for example, rounding or chamfering or other form of machining, the molding process can form the escape portion integrally with the release member, thereby reducing cost.

DETAILED DESCRIPTION OF ILLUSTRATIVE EMBODIMENTS

Figure 1:
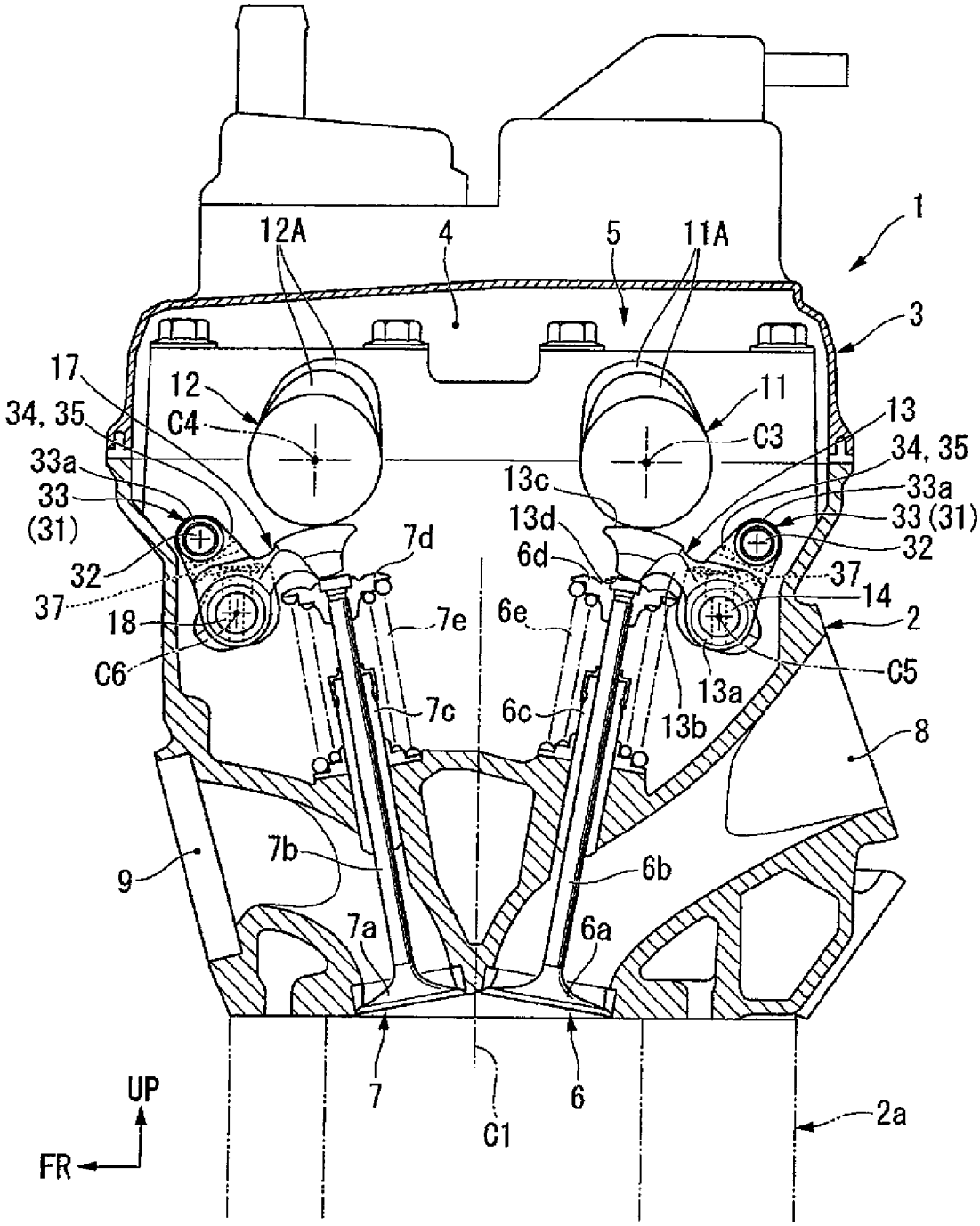
FIG. 1 is a left side elevational view illustrating a principal part of an engine according to an exemplary embodiment of the present invention.

An exemplary embodiment to which the present invention is applied will be described below with reference to the accompanying drawings. For convenience' sake, an arrow FR indicates forward, an arrow LH indicates leftward, and an arrow UP indicates upward as these symbols are used in the drawings.

Throughout this description, relative terms like "upper", "lower", "above", "below", "front", "back", and the like are used in reference to a vantage point of an operator of the vehicle, seated on the driver's seat and facing forward. It should be understood that these terms are used for purposes of illustration, and are not intended to limit the invention. It may be noted that the drawings shall be viewed based on the direction of reference numerals.

FIG. 1 is a left side elevational view showing a cylinder head 2 of a four-stroke double overhead camshaft (DOHC) inline four-cylinder engine 1 used in a vehicle, for example, a motorcycle. Specifically, in the depicted embodiment, the engine 1 is a four-valve-per-cylinder type, each cylinder having a pair of left and right intake valves 6 and a pair of left and right exhaust valves 7.

A head cover 3 is mounted on an upper portion (a distal end side) of the cylinder head 2, and cooperates therewith to form a valve-actuating chamber 4 in which a valve-actuating mechanism 5 is housed for selectively driving intake and exhaust valves 6, 7. In FIG. 1, reference numeral C1 denotes a central axis of a cylinder bore (cylinder axis) in a cylinder main body 2*a* that is joined to a lower portion (proximal end side) of the cylinder head 2.

The cylinder head 2 includes intake and exhaust ports 8, 9 formed therein at front and rear thereof. The intake and exhaust ports 8, 9 correspond to each cylinder. The intake and exhaust ports 8, 9 each form a pair of combustion chamber side openings, such each of the combustion chamber side openings is selectively opened or closed by a corresponding intake valve 6 or exhaust valve 7.

The intake and exhaust valves 6, 7 include umbrella-shaped valve heads 6*a*, 7*a* and bar-like stems 6*b*, 7*b*, respectively. Specifically, the valve heads 6*a*, 7*a* are to be aligned with the combustion chamber side openings. The stems 6*b*, 7*b* extend from the valve heads 6*a*, 7*a* toward the side of the valve-actuating chamber 4. The stems 6*b*, 7*b* of the respective intake and exhaust valves 6, 7 are held in position in the cylinder head 2 via valve guides 6*c*, 7*c*, respectively, so as to be able to make a slidable reciprocating motion. Retainers 6*d*, 7*d* are disposed at distal end portions of the stems 6*b*, 7*b* on the side of the valve-actuating chamber 4, respectively. Further, valve springs 6*e*, 7*e* are compressively disposed between the retainers 6*d*, 7*d* and the cylinder head 2, respectively.

Spring forces of the valve springs 6*e*, 7*e* urge the respective intake and exhaust valves 6, 7 upwardly, so that the valve heads 6*a*, 7*a* block the combustion chamber side openings. The respective intake and exhaust valves 6, 7 are forced to make a downward stroke by resisting the urging force of the valve springs 6*e*, 7*e*, which allows the valve heads 6*a*, 7*a* of the respective intake and exhaust valves 6, 7 to be spaced away from, and open the combustion chamber side openings.

The stems 6*b*, 7*b* of the respective intake and exhaust valves 6, 7 are inclined relative to the cylinder axis C1 so as to form a V shape in a side view, as shown. An intake-side camshaft 11 and an exhaust-side camshaft 12, each extending in a lateral direction, are disposed upwardly of the stems 6*b*, 7*b*, respectively. Each of the intake and exhaust-side camshafts 11, 12 is supported by the cylinder head 2 rotatably about an axis thereof and rotatably driven in liaison with a crankshaft via, a transmission mechanism such as a timing chain or belt and associated sprockets when the engine 1 is operated (both not shown). In FIG. 1, reference numerals C3 and C4 denote central axes (cam axes) of the respective intake and exhaust-side camshafts 11, 12, respectively.

Referring to FIGS. 1 to 3A-3B, the pair of left and right intake valves 6 for one cylinder is opened or closed by being pressed by cams 11A on the intake-side camshaft 11 via an intake-side rocker arm 13 provided for each cylinder. Similarly, the pair of left and right exhaust valves 7 for one cylinder is opened or closed by being pressed by cams 12A on the exhaust-side camshaft 12 via an exhaust-side rocker arm 17 provided for each cylinder.

The intake-side rocker arm 13 is supported, apart from the distal end portion of the stem 6*b* of the intake valve 6, by an intake-side rocker arm shaft 14 that is disposed in parallel with the intake-side camshaft 11. The intake-side rocker arm 13 is pivotally rockable about an axis of the intake-side rocker arm shaft 14, and is axially slidable thereon. Similarly, the exhaust-side rocker arm 17 is supported, apart from the distal end portion of the stem 7*b* of the exhaust valve 7, by an exhaust-side rocker arm shaft 18 that is disposed in parallel with the exhaust-side camshaft 12, is pivotally movable about an axis of the exhaust-side rocker arm shaft 18, and is axially slidable on the rocker arm shaft 18. In FIG. 1, reference numerals C5 and C6 denote central axes (rocker axes) of the respective intake and exhaust-side rocker arm shafts 14, 18, respectively.

The intake-side rocker arm 13 includes an arm portion 13*b*, which extends from a cylindrical shaft pass-through boss (base portion) 13*a* toward the distal end portion of the valve stem 6*b*. The intake-side rocker arm shaft 14 is passed through the cylindrical shaft pass-through boss (base portion) 13*a* of the rocker arm 13. A cam sliding contact portion 13*c* with which the cam 11A of the intake-side camshaft 11 makes a sliding contact is disposed on a top side of a distal end portion of the arm portion 13*b*, while a valve pressure portion 13*d* that abuts on the distal end portion of the stem 6*b* to press the stem 6*b* downwardly is disposed on a lower side of the distal end portion of the arm portion 13*b*. The exhaust-side rocker arm 17 has similar arrangements to those described above.

When the engine 1 is operated, each of the intake and exhaust-side camshafts 11, 12 is rotatably driven in liaison with a crankshaft (not shown), which results in each of the rocker arms 13, 17 being selectively and appropriately rocked according to a respective outer peripheral pattern of each of the cams 11A, 12A. Each of the rocker arms 13, 17 then presses the corresponding one of the intake and exhaust valves 6, 7, causing the intake valve 6 or the exhaust valve 7 to make a reciprocating motion to thereby open or close the combustion chamber side opening of the intake port 8 or the exhaust port 9.

The valve-actuating mechanism 5 according to the depicted embodiment is formed as a variable valve-actuating mechanism which is capable of varying a valve open/close timing or a lift amount of each of the intake and exhaust valves 6, 7. Specifically, when the engine runs, for example, in a low-speed range of less than 9000 revolutions per minute (rpm), the valve-actuating mechanism 5 uses a cam for a low speed rotation on each of the camshafts 11, 12 to open and close the corresponding one of the intake and exhaust valves 6, 7. However, when the engine runs in a high-speed range of 9000 rpm or higher, the valve-actuating mechanism 5 uses a cam for a high speed rotation on each of the camshafts 11, 12 to open and close the corresponding one of the intake and exhaust valves 6, 7.

The intake side operation for one cylinder in the valve-actuating mechanism 5 will be described. The same arrangements apply to the intake side and the exhaust side of each cylinder, so a redundant description of the exhaust side operation is omitted.

Figure 2A:
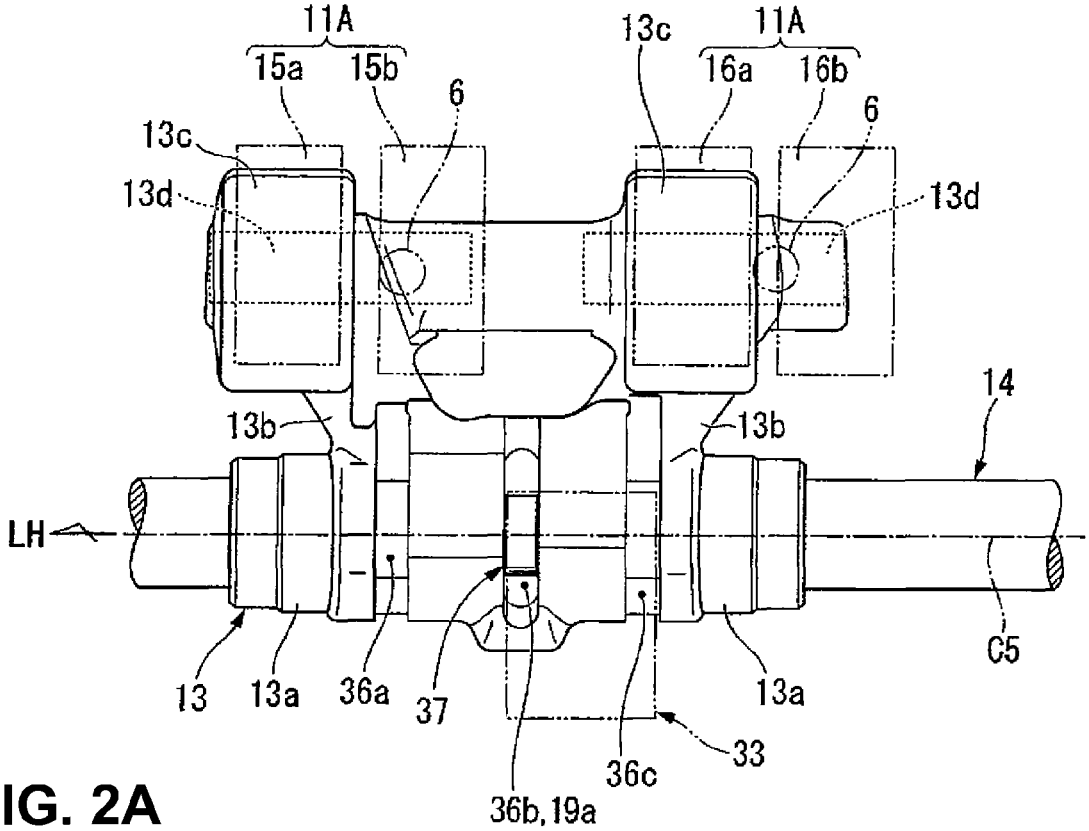
FIG. 2A is a plan view showing a valve-actuating mechanism of the engine according to an exemplary embodiment of the present invention, wherein the engine is operated at a low-speed range.
Figure 2B:
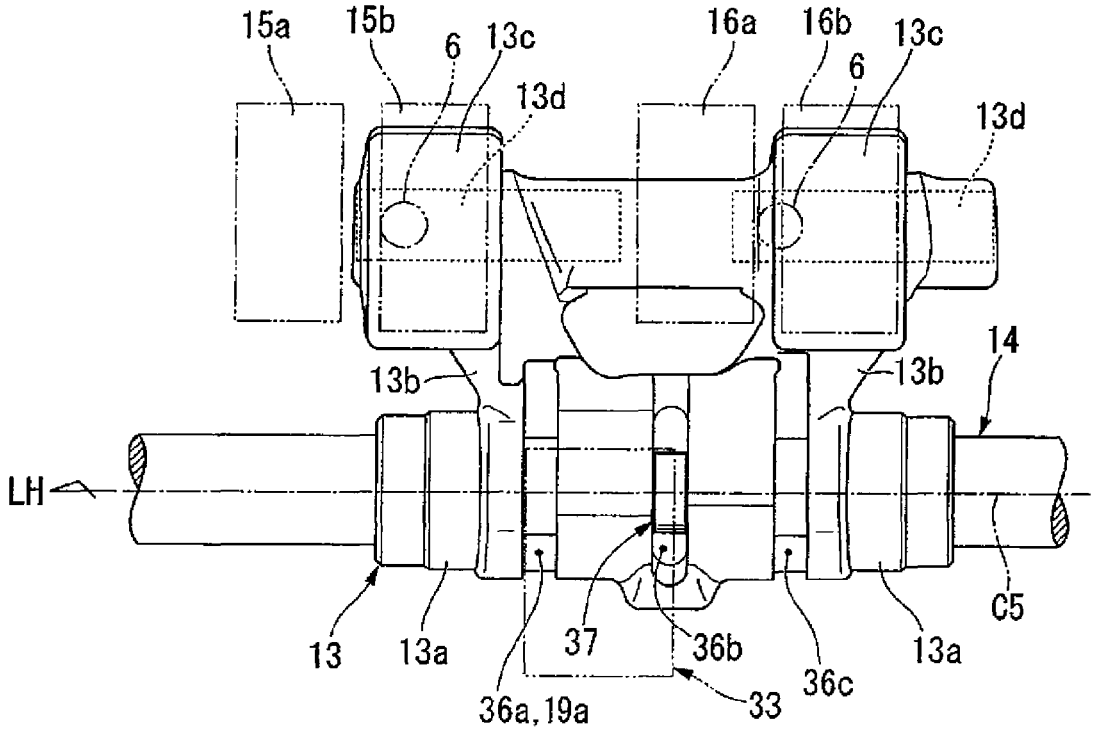
FIG. 2B is a plan view showing a valve-actuating mechanism of the engine according to an exemplary embodiment of the present invention, wherein the engine is operated at a high-speed range.

Referring to FIGS. 1 and 2A-2B, the cams 11A of the camshaft 11 include left and right first cams 15*a*, 16*a* for the low-speed range, and also include left and right second cams 15*b*, 16*b* for the high-speed range. Specifically, the camshaft 11 includes the left and right first cams 15*a*, 16*a* and the left and right second cams 15*b*, 16*b*, making a total of four cams for one cylinder.

The left and right first cams 15*a*, 16*a* share the same shape, and the left and right second cams 15*b*, 16*b* share the same shape. The left first cam 15*a* and the left second cam 15*b* adjoin each other laterally (in a camshaft direction) in the left-hand side of the cylinder. The right first cam 16*a* and the right second cam 16*b* adjoin each other laterally (in the camshaft direction) in the right-hand side of the cylinder.

The rocker arm 13 is supported by the rocker arm shaft 14 pivotally about the axis thereof (rocker axis C5; hereinafter may be referred to as "about the axis C5") and is slidably movable along the axis (in the direction along the rocker axis C5; hereinafter may be referred to as "axis C5 direction"). The rocker arm 13 extends widely in the lateral direction and integrally across the left and right intake valves 6. The cam sliding contact portions 13*c* and the valve pressure portions 13*d* of the rocker arm 13 are spaced laterally apart from each other and integrated with each other, respectively.

Figure 3A:
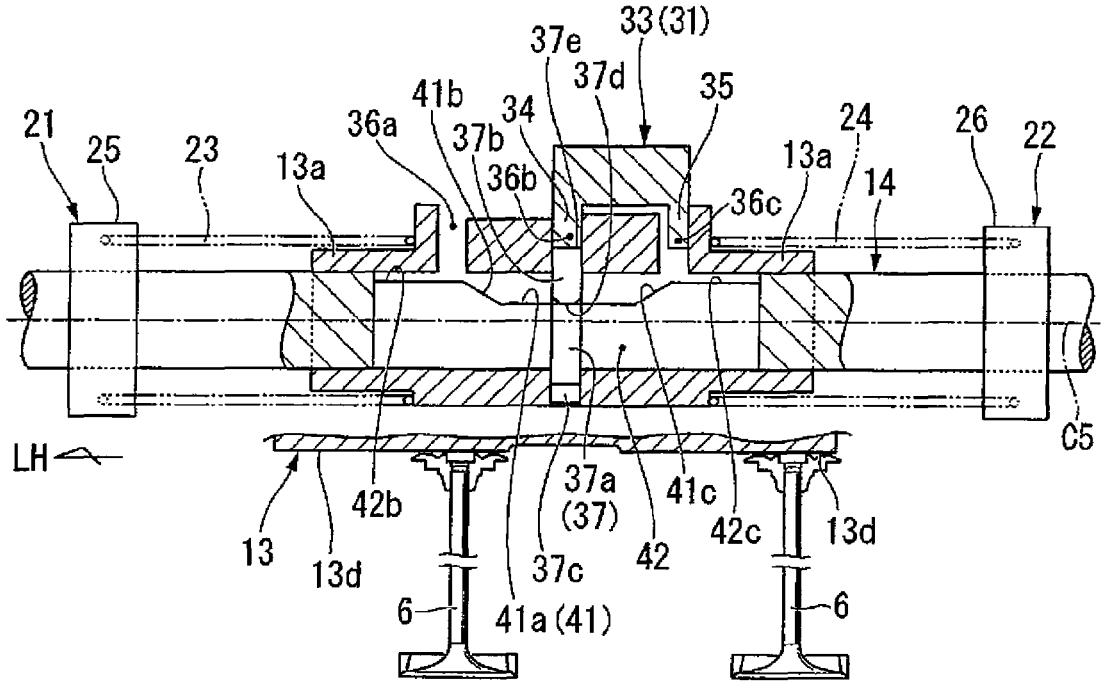
FIG. 3A is cross-sectional view taken along an axis of a rocker arm shaft of the valve-actuating mechanism according to an exemplary embodiment of the present invention, wherein the engine is operated at the low-speed range.

When the engine 1 is stationary or runs in the low-speed range, the rocker arm 13 is located at a leftward stroke limit position in the axis C5 direction (see FIG. 3A). In this condition, the left and right cam sliding contact portions 13*c* of the rocker arm 13 are disposed at positions downward of the left and right first cams 15*a*, 16*a* and to be in sliding contact with outer peripheral surfaces (cam surfaces) of the left and right first cams 15*a*, 16*a*. The left and right valve pressure portions 13*d* of the rocker arm 13 extend more widely laterally (in the axis C5 direction) than the left and right cam sliding contact portions 13*c*. When the rocker arm 13 is located at the leftward stroke limit position, the left and right valve pressure portions 13*d* are disposed such that right-hand side portions thereof can press the distal end portions of the stems 6*b* of the left and right intake valves 6. The position of the intake-side rocker arm 13 in the axis C5 direction at this time is referred to as a first operative position.

Figure 3B:
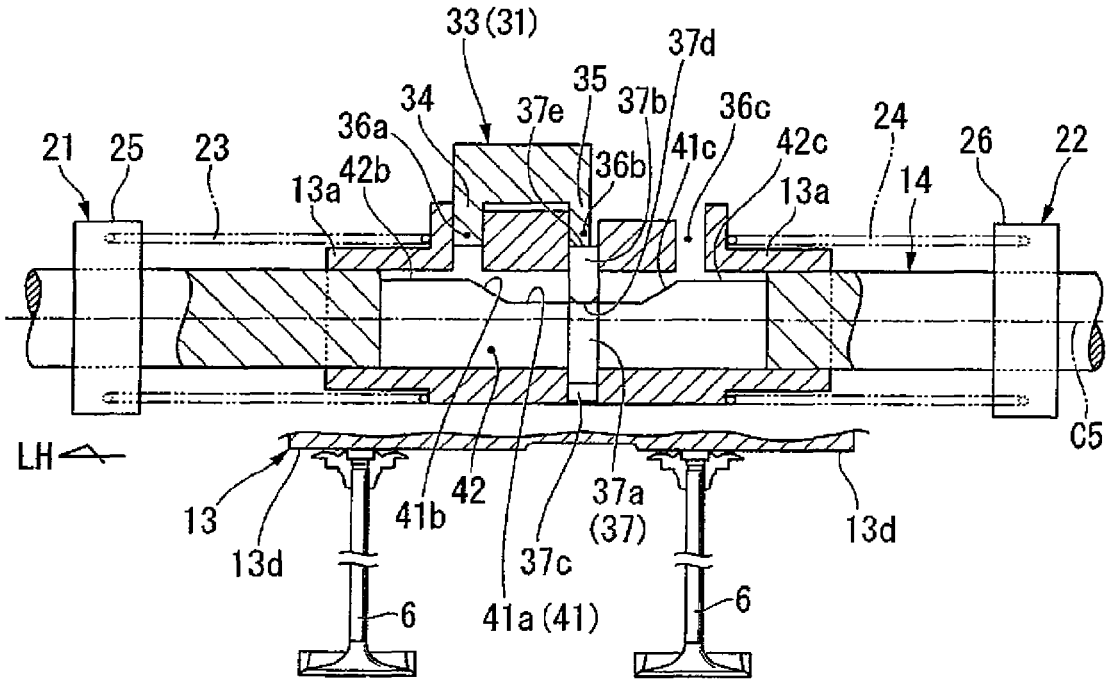
FIG. 3B is cross-sectional view taken along an axis of a rocker arm shaft of the valve-actuating mechanism according to an exemplary embodiment of the present invention, wherein the engine is operated at the high-speed range.

When the engine 1 runs in the high-speed range, on the other hand, the rocker arm 13 is located at a rightward stroke limit position in the axis C5 direction (see FIG. 3B). In this condition, the left and right cam sliding contact portions 13*c* of the rocker arm 13 are disposed at positions downward of the left and right second cams 15*b*, 16*b* and to be in sliding contact with outer peripheral surfaces (cam surfaces) of the left and right second cams 15*b*, 16*b*. When the rocker arm 13 is located at the rightward stroke limit position, the left and right valve pressure portions 13*d* of the rocker arm 13 are disposed such that left-hand side portions thereof can press the distal end portions of the stems 6*b* of the left and right intake valves 6. The position of the rocker arm 13 in the axis C5 direction at this time is referred to as a second operative position.

When the rocker arm 13 is located at the first operative position, the rocker arm 13 rocks according to the outer peripheral patterns of the left and right first cams 15*a*, 16*a* to open or close the intake valve 6. When the rocker arm 13 is located at the second operative position, on the other hand, the rocker arm 13 rocks according to the outer peripheral patterns of the left and right second cams 15*b*, 16*b* to open or close the intake valve 6.

Referring to FIGS. 3A-3B, the valve-actuating mechanism 5 uses first and second rocker arm moving mechanisms 21, 22, respectively, to store force for moving the rocker arm 13 in the axis C5 direction according to the engine speed. By using this force to move the rocker arm 13 to either the first operative position or the second operative position, the valve-actuating mechanism 5 can selectively use the left and right first cams 15*a*, 16*a* or the left and right second cams 15*b*, 16*b* for opening and closing the intake valve 6. Note that the first cams 15*a*, 16*a* are the cams for the low-speed range (low speed cams) having a smaller lift amount of the intake valve 6 than the second cams 15*b*, 16*b* do. The first cams 15*a*, 16*a* may be used as a stationary cam with a lift amount of 0 of the intake valve 6.

The first rocker arm moving mechanism 21 includes a first spring 23 and a first spring-receiving collar 25. Specifically, the first spring 23 is disposed leftwardly of the shaft pass-through boss 13*a* of the rocker arm 13, and gives a left end portion of the shaft pass-through boss 13*a* force acting from the side of the first operative position (low-speed side) to the side of the second operative position (high-speed side). The first spring-receiving collar 25 is disposed leftwardly of the first spring 23, and is fixedly supported on an outer periphery of the rocker arm shaft 14.

Similarly, the second rocker arm moving mechanism 22 includes a second spring 24 and a second spring-receiving collar 26. Specifically, the second spring 24 is disposed rightwardly of the shaft pass-through boss 13*a* of the rocker arm 13, and gives a right end portion of the shaft pass-through boss 13*a* force acting from the side of the second operative position to the side of the first operative position. The second spring-receiving collar 26 is disposed rightwardly of the second spring 24, and is also fixedly supported on the outer periphery of the rocker arm shaft 14.

The rocker arm shaft 14 is axially movably supported by the cylinder head 2. Axial movement of the rocker arm shaft 14 through, for example, an operation of an actuator (not shown) allows the force to move the rocker arm 13 to be stored in either the first rocker arm moving mechanism 21 or the second rocker arm moving mechanism 22.

When the engine 1 is stationary or runs in the low-speed range (during a low-speed operation), the rocker arm shaft 14 and the spring-receiving collars 25, 26 are located at their respective axially leftward stroke limit positions (see FIG. 3A). At this time, the rocker arm 13 is located at the above-mentioned first operative position and the springs 23, 24 are compressively disposed between the shaft pass-through boss 13*a* of the rocker arm 13 and the spring-receiving collars 25, 26.

When the engine 1 runs in the high-speed range (during a high speed operation), the rocker arm shaft 14 and the spring-receiving collars 25, 26 are located at their respective axially rightward stroke limit positions (see FIG. 3B). At this time, the rocker arm 13 is located at the above-mentioned second operative position and the springs 23, 24 are compressively disposed between the shaft pass-through boss 13*a* of the rocker arm 13 and the spring-receiving collars 25, 26.

When the rocker arm 13 is to be moved from one operative position to another, the rocker arm shaft 14 and a corresponding one of the spring-receiving collars 25, 26 are integrally moved in the axis C5 direction relative to the cylinder head 2 with movement of the rocker arm 13 in the axis C5 direction restricted using a trigger arm 33 of a movement-restricting mechanism 31. A predetermined elastic force difference between the springs 23, 24 is thereby produced and, using the elastic force difference (an elastic force stored in either the first spring 23 or the second spring 24), the rocker arm 13 is moved from one operative position to another.

Referring now to FIGS. 1 to 4, the movement-restricting mechanism 31 mainly includes the trigger arm 33, three engagement grooves 36*a*, 36*b*, 36*c*, and a trigger pin 37. Specifically, the trigger arm 33 is supported on the cylinder head 2 via a support shaft 32 extending in parallel with the rocker arm shaft 14, is pivotally about the support shaft 32, and is axially immovable thereon. The three engagement grooves 36*a*, 36*b*, 36*c* are formed in the shaft pass-through boss 13*a* of the rocker arm 13, arranged laterally so as to allow a pair of left and right engagement pawls 34, 35 of the trigger arm 33 to be selectively engaged therewith. The trigger pin 37 vertically penetrates through the shaft pass-through boss 13*a* of the rocker arm 13 and the rocker arm shaft 14, in a direction orthogonal to the axis C5 direction (axis C5 orthogonal direction).

The support shaft 32 of the trigger arm 33 is disposed above the rocker arm shaft 14, and is offset from the cylinder (on the side spaced away from the cylinder axis C1).

The trigger arm 33 is formed by extending the left and right engagement pawls 34, 35 outwardly from a shaft pass-through boss 33*a*, through which the support shaft 32 is passed toward the side of the rocker arm shaft 14.

When the rocker arm 13 is in any of the operative positions, the trigger arm 33 engages the left and right engagement pawls 34, 35 with corresponding ones of the engagement grooves 36*a*, 36*b*, 36*c*, thereby temporarily disabling the rocker arm 13 from sliding in the axis C5 direction. This condition is referred to as a pre-rock state of the trigger arm 33.

The rocker arm 13 becomes slidable in the axis C5 direction when the trigger arm 33 rocks in a direction opposite the rocker arm 13 (toward the side of being spaced away from the rocker arm 13) to thereby disengage the left and right engagement pawls 34, 35 from the engagement grooves 36*a*, 36*b*, 36*c*.

Referring to FIGS. 3A-3B, the rocker arm shaft 14 includes a cutout recessed portion 41 extending over a predetermined length in the axis C5 direction. The cutout recessed portion 41 is formed in an upper portion outer periphery of a section in the rocker arm shaft 14 that is passed into the shaft pass-through boss 13*a*. The rocker arm shaft 14 also includes a through hole 42 formed therein. The through hole 42 is a slit-like hole extending along the axis C5 direction and penetrating vertically through the rocker arm shaft 14 in the axis C5 orthogonal direction. The through hole 42 extends over a range longer than the cutout recessed portion 41 in the axis C5 direction. The trigger pin 37 is passed from an upward direction through this through hole 42 and retained movably in the axis C5 direction.

When the rocker arm shaft 14 is moved, from the condition in which the rocker arm 13 is in any of the operative positions, in the axis C5 direction through, for example, an operation of an actuator (not shown) with the movement in the axis C5 direction of the rocker arm 13 being limited by the movement-restricting mechanism 31, the trigger arm 33 cooperates with the cutout recessed portion 41 to move a predetermined amount upwardly in the axis C5 orthogonal direction. This causes the trigger pin 37 to move up and down in the center engagement groove 36*b* as the rocker arm shaft 14 slides.

Either one of the left and right engagement pawls 34, 35 of the trigger arm 33 fits in from an upward direction, and is engaged with, the center engagement groove 36*b*. Upward movement of the trigger pin 37 in this condition causes the trigger arm 33 to rock a predetermined amount toward the side of disengaging from the center engagement groove 36*b* and eventually from the rocker arm 13. Subsequent continued rocking motion of the rocker arm 13 disengages the trigger arm 33 from the rocker arm 13 after a predetermined amount of rocking, so that the rocker arm 13 becomes movable from one operative position to another.

Figure 6:
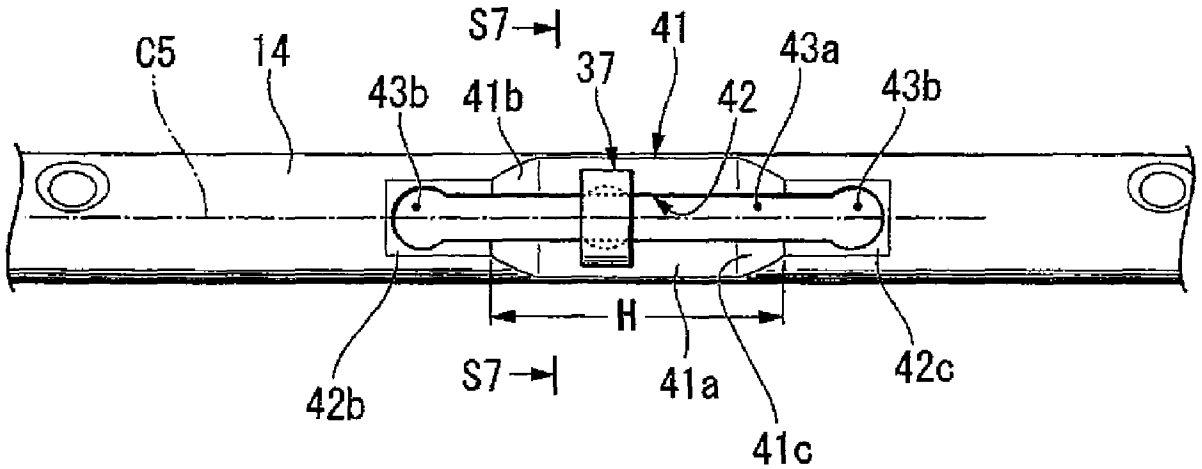
FIG. 6 is a plan view showing a principal part of the rocker arm shaft according to an exemplary embodiment of the present invention.

Referring now to FIGS. 3A-3B and 6, the cutout recessed portion 41 in the rocker arm shaft 14 includes a bottom surface 41*a* and left and right inclined surfaces 41*b*, 41*c*. Specifically, the bottom surface 41*a* is a flat surface extending in parallel with the axis C5 direction. The left and right inclined surfaces 41*b*, 41*c* join to the bottom surface 41*a* on either side in the axis C5 direction, extending obliquely upwardly relative to the bottom surface 41*a*. The bottom surface 41*a* is wider in width (length) in the axis C5 direction than each of the left and right inclined surfaces 41*b*, 41*c* in the axis C5 direction.

At a substantially central portion in width in the axis C5 orthogonal direction in the cutout recessed portion 41, the slit-like through hole 42 is formed to extend over a range longer than an overall length of the cutout recessed portion 41 in the axis C5 direction. In addition, left and right flat surfaces 42*b*, 42*c* are formed around portions outside the cutout recessed portion 41 on both sides in the axis C5 direction of the through hole 42. The flat surfaces 42*b*, 42*c* join to either side in the axis C5 direction of the through hole 42, extending in parallel with the axis C5 direction. The trigger pin 37 is passed through and retained in the through hole 42.

Referring also to FIGS. 5A-5D, the trigger pin 37 is formed to include a pass-through portion 37*a*, an upper expanded portion 37*b*, and a lower expanded portion 37*c*. Specifically, the pass-through portion 37*a* is passed into the through hole 42 from an upward direction and retained therein movably in the axis C5 direction and relatively unrotatably about the axis C5. The upper expanded portion 37*b* is formed on the upper end side of the pass-through portion 37*a* and to have a longitudinal width in the axis C5 orthogonal direction which is wider than the pass-through portion 37*a* and the through hole 42. The lower expanded portion 37*c* is formed on the lower end side of the pass-through portion 37*a* and to have a longitudinal width in the axis C5 orthogonal direction which is wider than the pass-through portion 37*a* and the through hole 42.

Figure 5A:
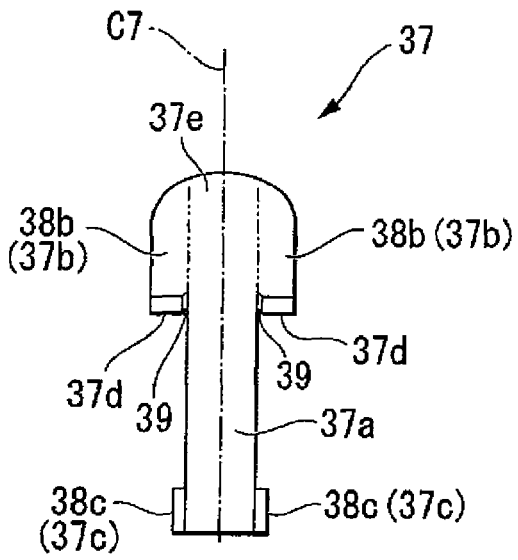
FIG. 5A is a front elevational view of a trigger pin illustrations showing a trigger pin of the valve-actuating mechanism as viewed from the direction of the axis according to an exemplary embodiment of the present invention.
Figure 5B:
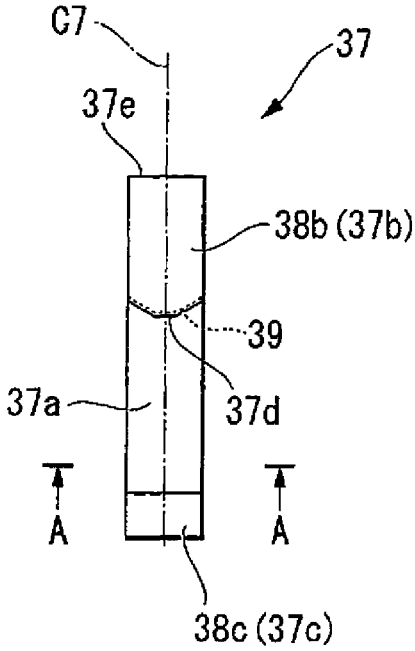
FIG. 5B is a side elevational view of the trigger pin of FIG. 5A.

The pass-through portion 37*a* is formed with a rectangular columnar shape having a longitudinal and lateral width substantially equivalent to, or slightly smaller than a width of the through hole 42 in the axis C5 orthogonal direction. In FIGS. 5A-5B, reference numeral C7 denotes an axis extending in a direction in which the pass-through portion 37*a* (trigger pin 37) is passed into the through hole 42.

The upper expanded portion 37*b*, on the other hand, is a thick wall sheet shape that is orthogonal to the axis C5 direction and has an axis C5 direction width (thickness) equivalent to the pass-through portion 37*a* and each of the engagement grooves 36*a*, 36*b*, 36*c*.

The upper expanded portion 37*b* includes an apex portion 37*e* that is arcuately curved when viewed in the axis C5 direction. Additionally, the upper expanded portion 37*b* includes a pair of lower side portions disposed on both sides at front and rear across the pass-through portion 37*a*. The lower side portions extend linearly along the axis C5 orthogonal direction. The two lower side portions of the upper expanded portion 37*b* serve as supported portions 37*d* that can be brought into abutment from an upward direction with the bottom surface 41*a* and the left and right inclined surfaces 41*b*, 41*c* of the cutout recessed portion 41 and the left and right flat surfaces 42*b*, 42*c*. Thanks to the supported portions 37*d*, when the trigger pin 37 is assembled in the rocker arm shaft 14, the trigger pin 37 is supported by the rocker arm shaft 14 without falling off and in a state of being able to move upwardly. Portions protruding longitudinally from front and rear edges of the pass-through portion 37*a* in the upper expanded portion 37*b* will hereinafter be referred to as an expanded portion 38*b*. The front and rear expanded portions 38*b* and the apex portion 37*e* (abutment portion relative to the trigger arm 33) of the trigger pin 37 are continuous and flush with each other.

The lower expanded portion 37*c*, on the other hand, is formed to have a longitudinal width and a vertical width smaller than those of the upper expanded portion 37*b*. The upper expanded portion 37*b* includes front and rear end portions that are formed into arcs about the axis C7 as viewed in the direction of the axis C7 (axial view). Note that four edge portions in the pass-through portion 37*a* along the axis C7 are chamfered along the arcuate shapes of the lower expanded portion 37*c* in the axial view.

Figure 5C:
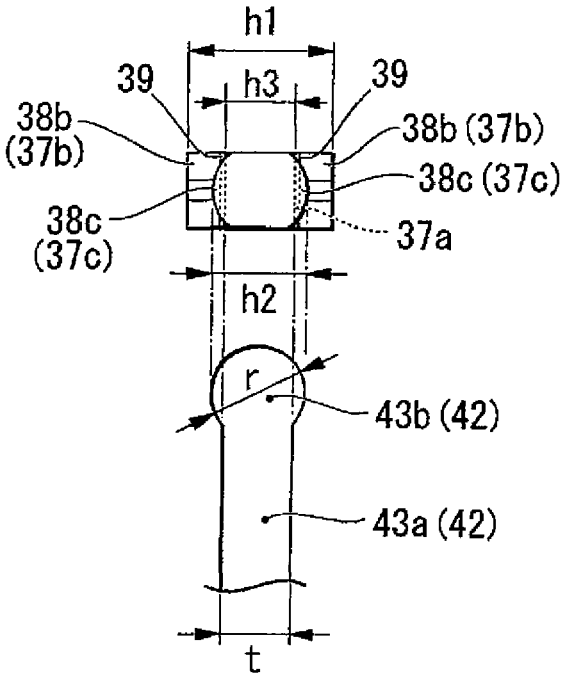
FIG. 5C is a bottom plan view of the trigger pin of FIG. 5A.
Figure 5D:
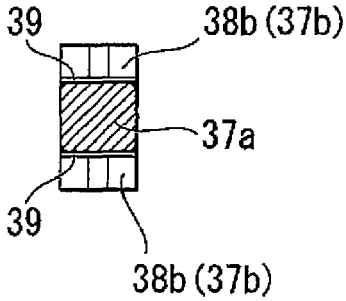
FIG. 5D is a cross-sectional view taken along line A-A of FIG. 5B.
Figure 7A:
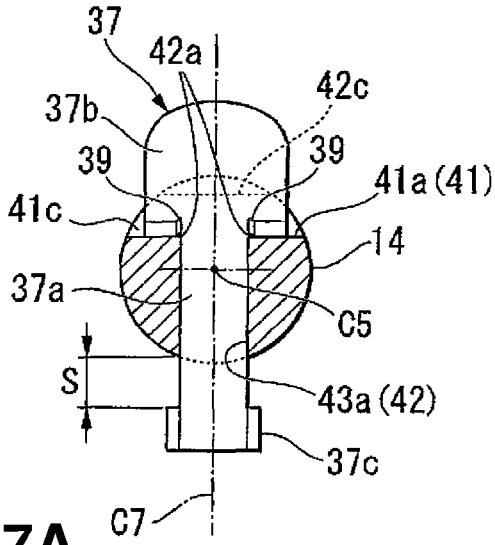
FIG. 7A is a cross-sectional view taken along line S7-S7 of FIG. 6 showing a condition in which the variable valve-actuating mechanism according to an embodiment of the present invention is operated normally.

Referring to FIG. 5C, the lower expanded portion 37*c* has a longitudinal width h2 larger than a short side dimension (a longitudinal width or a width in the axis C5 orthogonal direction) t of a slot portion 43*a* of the through hole 42. Further, when the supported portions 37*d* are supported on the bottom surface 41*a*, an upper end surface of the lower expanded portion 37*c* is spaced away downwardly by a predetermined amount S from a lower end opening of the through hole 42 (see FIG. 7A). When the trigger pin 37 is assembled in the rocker arm shaft 14, the lower expanded portion 37*c* allows the trigger pin 37 to move upwardly by the predetermined amount S. To state it another way, the trigger pin 37 is integrally assembled in the rocker arm shaft 14 in a condition of being able to move by the predetermined amount S (in a condition of being prevented from slipping out of position). Portions in the lower expanded portion 37*c* protruding to the front or rear from front and rear edges of the pass-through portion 37*a* will hereinafter be referred to as a small protrusion portion 38*c*.

Note that a longitudinal width h1 of the upper expanded portion 37*b* is greater than any of the short side dimension (longitudinal width) t of the slot portion 43*a*, the longitudinal width h2 of the lower expanded portion 37*c*, and a longitudinal width h3 of the pass-through portion 37*a*.

When the engine 1 is run in the low-speed range or the high-speed range, the trigger pin 37 is supported with its front and rear supported portions 37*d* resting on a substantially central portion in the bottom surface 41*a* of the cutout recessed portion 41 in the axis C5 direction (see FIGS. 3A-3B). At this time, an upper portion of the upper expanded portion 37*b* and a lower portion of the lower expanded portion 37*c* protrude to the outer peripheral side of the rocker arm shaft 14.

The center engagement groove 36*b* in the shaft pass-through boss 13*a* of the rocker arm 13 includes an upper fit hole 19*a* formed in a bottom portion thereof, into which the upper portion of the upper expanded portion 37*b* can be passed and fitted (see FIGS. 2A-2B). The shaft pass-through boss 13*a* also includes a lower fit hole (not shown) formed in a portion thereof diametrically opposite the upper fit hole 19*a*. The lower portion of the lower expanded portion 37*c* can be passed and fitted into the lower fit hole. Each of the upper fit hole 19*a* and the lower fit hole is formed into a slit-like shape having a width equivalent to a thickness of the trigger pin 37.

The trigger pin 37 is able to move in the axis C5 direction with the rocker arm 13 relative to the rocker arm shaft 14, when its upper and lower portions are passed and fitted into the above-mentioned upper fit hole 19*a* and lower fit hole, respectively. At the same time, the trigger pin 37 is prevented from collapsing, which would otherwise displace the upper and lower portions in the axis C5 direction, or rotating about its own vertical axis.

Figure 7B:
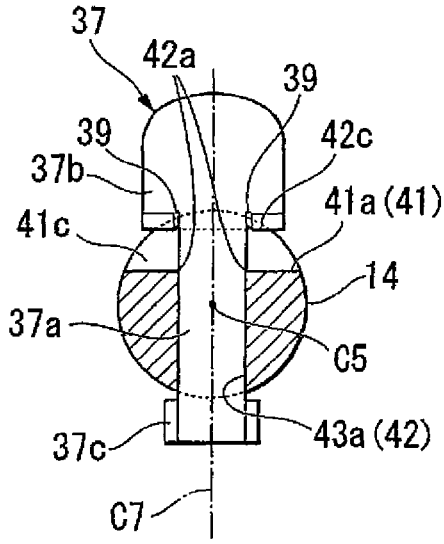
FIG. 7B is a cross-sectional view taken along line S7-S7 of FIG. 6 showing a condition in which cams of the valve-actuating mechanism of an exemplary embodiment of the present invention are being changed.
Figure 7C:
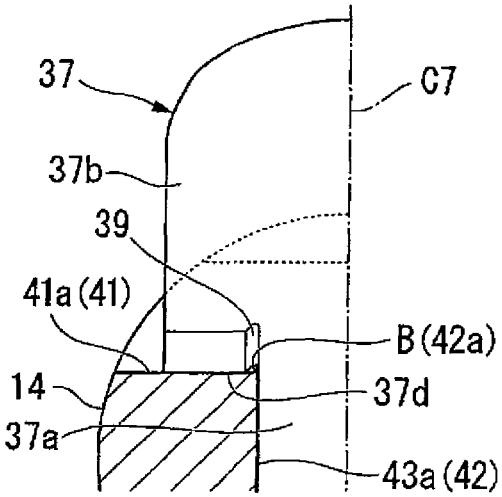
FIG. 7C is an enlarged view showing a portion of the valve-actuating mechanism of FIG. 7A.

When, from the condition in which the rocker arm 13 is in any of the operative positions and the two supported portions 37*d* are supported on the substantially central portion in the bottom surface 41*a*, the rocker arm shaft 14 is moved in the axis C5 direction with the movement in the axis C5 direction of the rocker arm 13 restricted by the movement-restricting mechanism 31, the supported portions 37*d* ride over either the left inclined surface 41*b* or the right inclined surface 41*c* on the corresponding sides of the bottom surface 41*a*. This results in the trigger arm 33 moving upwardly in the axis C5 orthogonal direction (see FIG. 7B). Note that left and right edge portions in the supported portions 37*d* along the longitudinal direction are planarly chamfered to form a substantially identical angle with the left and right inclined surfaces 41*b*, 41*c* in order to ensure smooth riding over the inclined surfaces 41*b*, 41*c* from the bottom surface 41*a* (see FIG. 5B).

Referring now to FIGS. 5 and 7, front and rear lower edge portions (the front and rear supported portions 37*d*) of the upper expanded portion 37*b* of the trigger pin 37 include groove portions 39 formed at proximal end sides thereof. The groove portion 39 has, for example, a substantially semi-circular cross section and forms an inner side surface that is flush with a corresponding one of front and rear edges of the pass-through portion 37*a*.

Figure 7D:
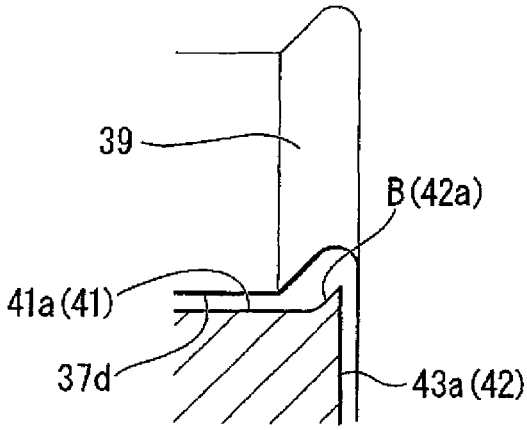
FIG. 7D is an enlarged view showing a portion of the valve actuation mechanism of FIG. 7B.

The groove portions 39 face from above upper corner portions 42*a* that extend over the bottom surface 41*a*, the left and right inclined surfaces 41*b*, 41*c*, the left and right flat surfaces 42*b*, 42*c* of the cutout recessed portion 41 in the through hole 42. The groove portions 39 avoid burrs B (see FIGS. 7C and 7D) left at the upper corner portions 42*a* during forming of the through hole 42 to thereby inhibit the burrs B from contacting the trigger pin 37. Specifically, the groove portions 39 are formed so as to have a cross-sectional shape that is larger than the burrs B expected to occur at the upper corner portions 42*a* of the through hole 42. Note that the semi-circle is not the only possible cross-sectional shape for the groove portion 39; rather, the groove portion 39 may have a substantially triangular cross section having an inclined surface as shown in FIG. 7D, or a trapezoidal or rectangular cross-sectional shape.

The trigger pin 37 as described above is manufactured through molding using a mold and the groove portions 39 are formed simultaneously during the molding process. The molding process helps reduce cost of the valve-actuating mechanism 5 without involving an increased number of manufacturing processes as compared with a case in which the burrs B of the upper corner portions 42*a* of the through hole 42 are removed through, for example, machining.

Figure 4:
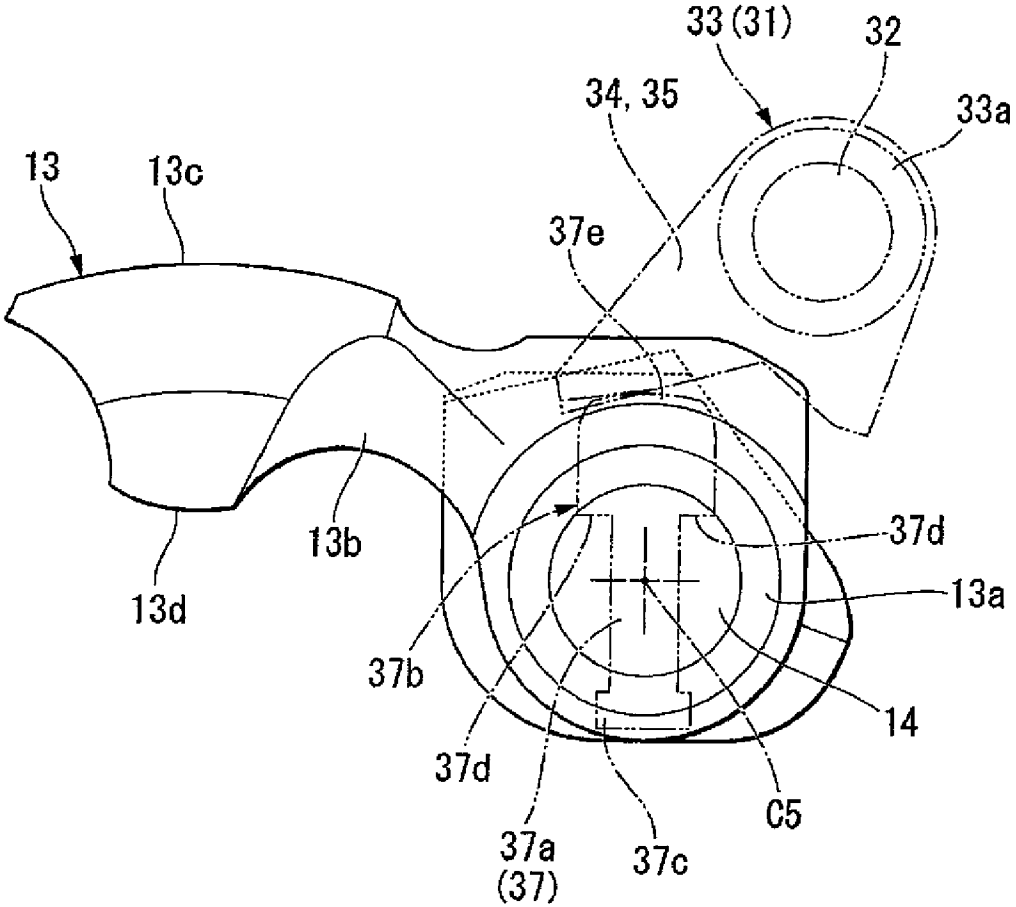
FIG. 4 is a left side elevational view showing components around a rocker arm of the valve-actuating mechanism according to an exemplary embodiment of the present invention.

Referring now to FIG. 4, either one of the left and right engagement pawls 34, 35 of the trigger arm 33 fits in from an upward direction, and is engaged with, the center engagement groove 36*b*, so that a lower edge portion of the engagement pawl 34 or 35 abuts on the apex portion 37*e* of the upper expanded portion 37*b* of the trigger pin 37. Upward movement of the trigger pin 37 in this condition causes the trigger arm 33 to rock a predetermined amount toward the side of disengaging from the center engagement groove 36*b* and eventually the rocker arm 13.

To store a predetermined force in the first rocker arm moving mechanism 21 in order to move the rocker arm 13 which is now in the first operative position (see FIGS. 2A and 3A) to the second operative position, the rocker arm shaft 14 located at the leftward stroke limit position is first moved rightwardly with the corresponding one of the spring-receiving collars 25, 26 in a condition in which the rocker arm 13 is continuously rockable by a rotatable drive of the intake-side camshaft 11.

As the rocker arm shaft 14 is axially moved, the supported portions 37*d* of the trigger pin 37 ride over the left inclined surface 41*b* of the cutout recessed portion 41. This moves the trigger pin 37 in the axis C5 orthogonal direction, causing the apex portion 37*e* of the trigger pin 37 to push the left and right engagement pawls 34, 35 of the trigger arm 33 upwardly in the pre-rock state, so that the trigger arm 33 rocks clockwise (in the direction opposite the rocker arm 13), as seen in FIGS. 1 and 4.

When, on the other hand, the rocker arm shaft 14 and the corresponding one of the spring-receiving collars 25, 26 reach the rightward stroke limit position from the leftward stroke limit position, the first spring 23 disposed between the first spring-receiving collar 25 and the shaft pass-through boss 13*a* of the rocker arm 13, the motion of which is restricted, is compressed a predetermined amount, as described above. This results in the first spring 23 storing the elastic force for moving the rocker arm 13 from the first operative position to the second operative position.

As such, engagement between the rocker arm 13 and the trigger arm 33 is disengaged when the rocker arm shaft 14 is moved to the rightward stroke limit position, the condition in which the rocker arm 13 is continuously rockable, and at the first operative position, so that restriction of rightward movement of the rocker arm 13 relative to the cylinder head 2 at the position in question is canceled. As a result, the rocker arm 13 is moved to the second operative position by the elastic force stored in the first spring 23. After the rocker arm 13 has moved to the second operative position, the trigger arm 33 is again engaged with the rocker arm 13, thus restricting the sliding motion of the rocker arm 13 in the axis C5 direction.

Next, to store a predetermined force in the second rocker arm moving mechanism 22 in order to move the rocker arm 13 which is at the second operative position (see FIGS. 2B and 3B) to the first operative position, the rocker arm shaft 14 located at the rightward stroke limit position is moved leftwardly with the corresponding one of the spring-receiving collars 25, 26 in the same condition in which the rocker arm 13 is continuously rockable.

As the rocker arm shaft 14 is axially moved, the supported portions 37*d* of the trigger pin 37 ride over the right inclined surface 41*c* of the cutout recessed portion 41. This moves the trigger pin 37 in the axis C5 orthogonal direction, causing the apex portion 37*e* of the trigger pin 37 to push the left and right engagement pawls 34, 35 of the trigger arm 33 upwardly in the pre-rock state, so that the trigger arm 33 rocks clockwise (in the direction opposite the rocker arm 13), as seen in FIGS. 1 and 4.

When, on the other hand, the rocker arm shaft 14 and the corresponding one of the spring-receiving collars 25, 26 reach the leftward stroke limit position from the rightward stroke limit position, the second spring 24 disposed between the second spring-receiving collar 26 and the shaft pass-through boss 13*a* of the rocker arm 13, the motion of which is restricted, is compressed a predetermined amount, as described above. This results in the second spring 24 storing the elastic force for moving the rocker arm 13 from the second operative position to the first operative position.

As such, engagement between the rocker arm 13 and the trigger arm 33 is disengaged when the rocker arm shaft 14 is moved to the leftward stroke limit position, the condition in which the rocker arm 13 is continuously rockable, and at the second operative position, so that restriction of leftward movement of the rocker arm 13 relative to the cylinder head 2 at the position in question is canceled. As a result, the rocker arm 13 is moved to the first operative position by the elastic force stored in the second spring 24. After the rocker arm 13 has moved to the first operative position, the trigger arm 33 is again engaged with the rocker arm 13, thus restricting the sliding motion of the rocker arm 13 in the axis C5 direction.

As described above, valve overlap can be minimized and the lift amount held low in the low-speed range of the engine 1, while valve overlap can be increased and the lift amount increased in the high-speed range of the engine 1, by appropriately varying the open/close timing and valve lift amount of the intake valve 6 according to the speed of the engine 1 (speed of a crankshaft (not shown)), whether the engine 1 is stationary or run in the low-speed range, or the engine 1 is run in the high-speed range.

As described above, when the rocker arm 13 is to be moved in the axis C5 direction, the trigger pin 37 is also moved with the rocker arm 13 in the axis C5 direction relative to the rocker arm shaft 14. A movement range H of the trigger pin 37 is between outside portions of the left and right inclined surfaces 41*b*, 41*c* of the cutout recessed portion 41 (see FIG. 6). The left and right end portions of the slit-like through hole 42 extend up to points left and right outside the cutout recessed portion 41 (up to the left and right flat surfaces 42*b*, 42*c*). The left and right end portions of the through hole 42 include circular hole portions 43*b* formed therein for assembling the trigger pin 37 to the rocker arm shaft 14.

Referring to FIG. 5C, the circular hole portion 43*b* is formed into a circular hole shape having an inside diameter r larger than the short side dimension t of the slot portion 43*a* of the through hole 42, specifically, having substantially the same diameter as the arc of the lower expanded portion 37*c* in the axial view. The circular hole portion 43*b* is formed to allow the lower expanded portion 37*c* to be passed therethrough. The trigger pin 37 can then be inserted into the through hole 42 as follows: specifically, the rocker arm shaft 14 is passed into the shaft pass-through boss 13*a* and, with the upper and lower fit holes in the shaft pass-through boss 13*a* aligned with the position of the circular hole portion 43*b* in the axis C5 direction, the trigger pin 37 is inserted with the lower expanded portion 37*c* first so that the trigger pin 37 penetrates through the upper and lower fit holes and the circular hole portion 43*b* (see FIG. 8A). At this time, the supported portions 37*d* of the upper expanded portion 37*b* abut on front and rear edges of an upper end opening in the circular hole portion 43*b*, which prevents the trigger pin 37 from slipping out of position downwardly.

Figure 8B:
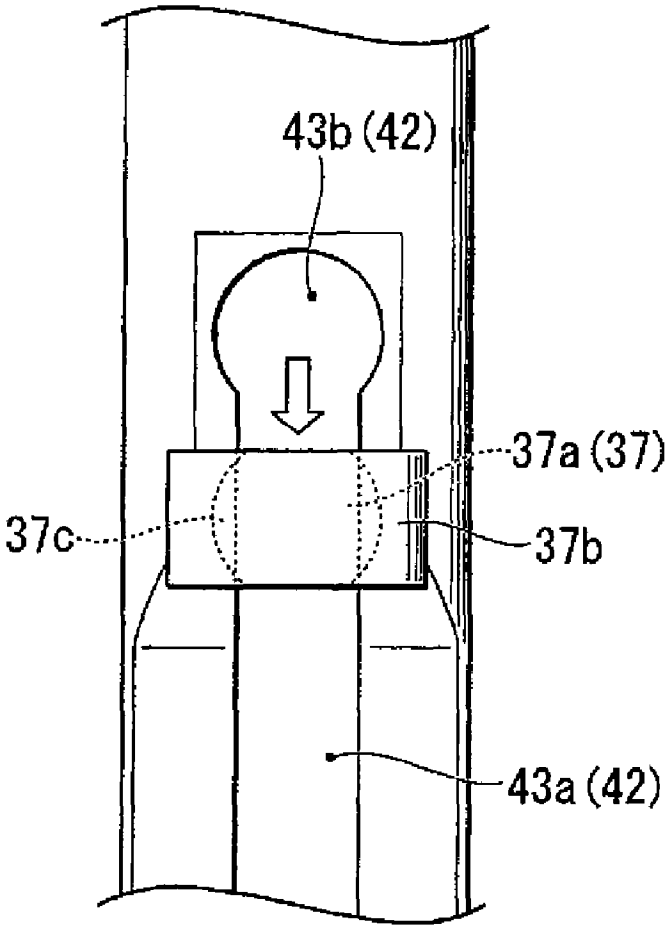
FIG. 8B is an explanatory view of a mounting procedure for the trigger pin in the rocker arm shaft showing a condition in which the trigger pin is moved to a slot portion of the shaft insertion aperture.
Figure 8A:
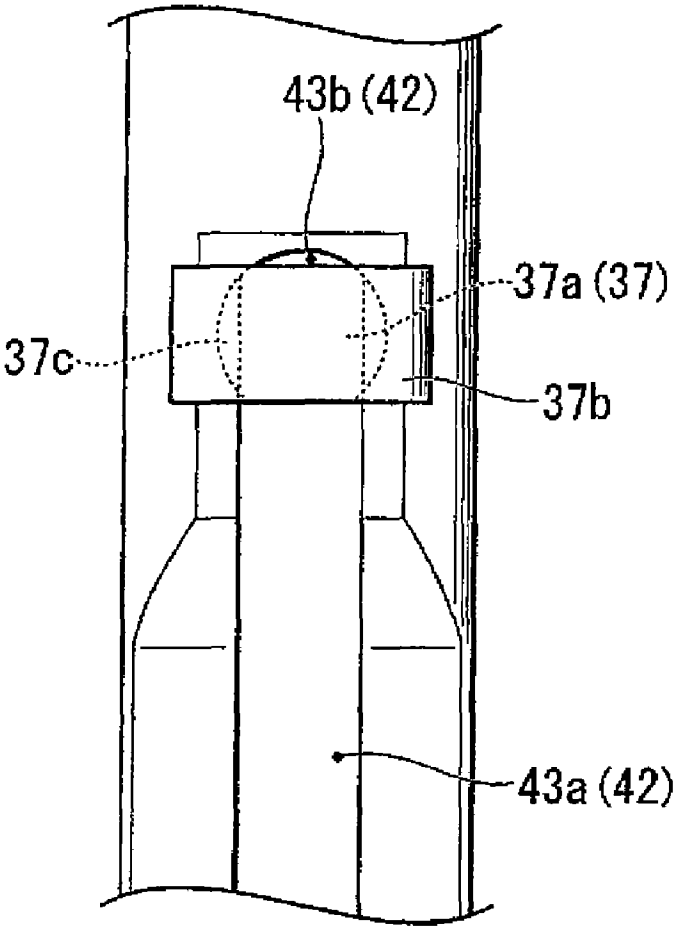
FIG. 8A is an explanatory view of a mounting procedure for the trigger pin in the rocker arm shaft showing a condition in which the trigger pin is inserted into a circular hole portion of a shaft insertion aperture.
Figure 9:
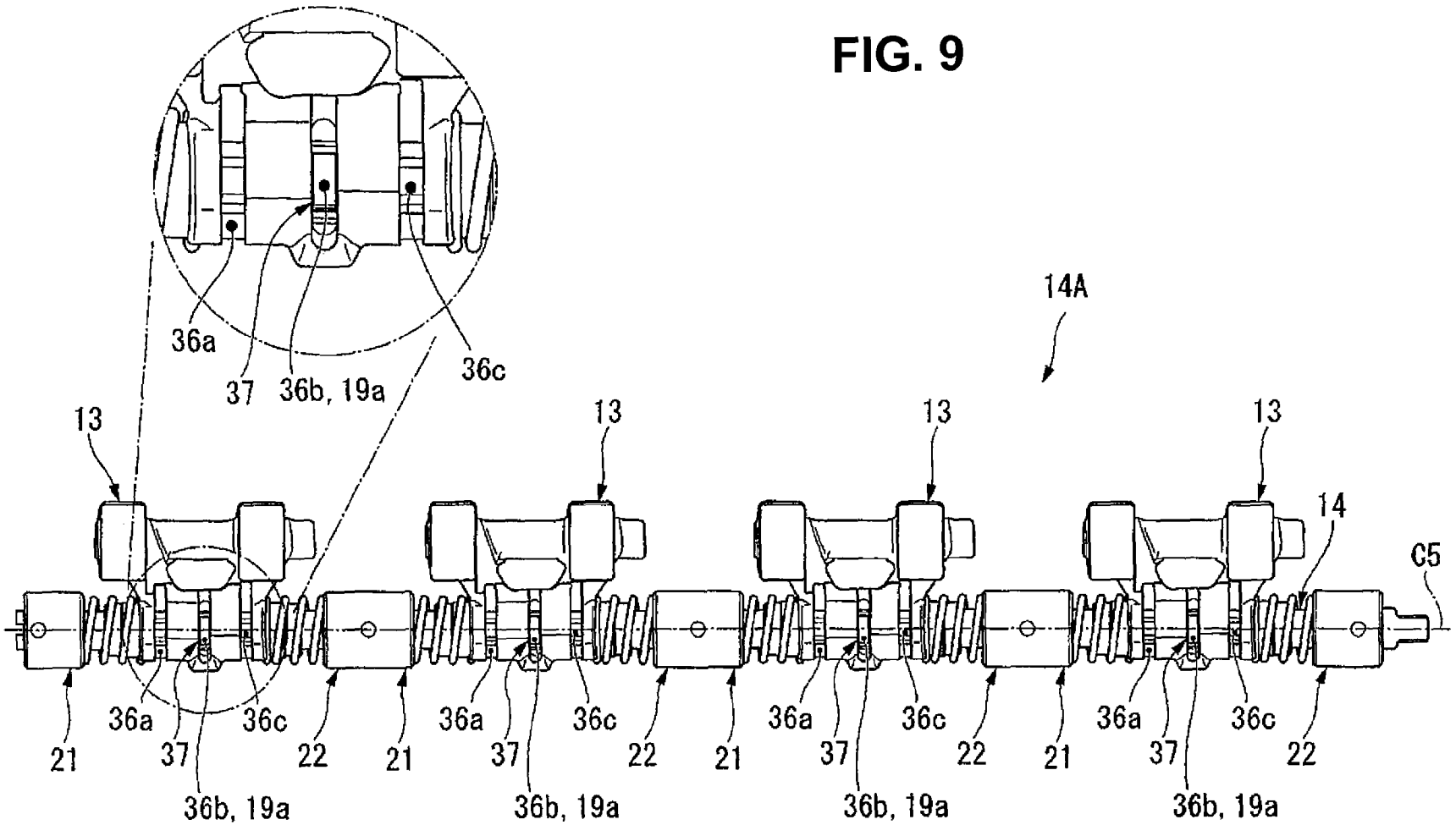
FIG. 9 is a plan view showing a rocker arm shaft assembly according to an exemplary embodiment of the present invention.

The trigger pin 37, together with the rocker arm 13, is thereafter slid to the side of the cutout recessed portion 41 (see FIG. 8B). This allows the trigger pin 37 to be assembled with the rocker arm shaft 14 in the condition of being able to move the predetermined amount S (in the condition of being prevented from slipping out of position) as described earlier. The foregoing assembly procedure is performed for the number of cylinders provided. Further, the rocker arm moving mechanisms 21, 22 are installed between the rocker arms 13 and the spring-receiving collars 25, 26 of the rocker arm moving mechanisms 21, 22 are positioned using lock pins. This constitutes a rocker arm shaft assembly 14A including the rocker arm shaft 14 on which the rocker arm 13 and the rocker arm moving mechanisms 21, 22 for each cylinder are integrally mounted (see FIG. 9).

In a condition in which the rocker arm shaft assembly 14A is yet to be assembled in the engine main body, the trigger pin 37 is disposed within the width (lateral width) of the bottom portion of the cutout recessed portion 41 in the axis C5 direction. In this condition, the upper and lower expanded portions 37*b*, 37*c* of the trigger pin 37 are caught by edges of the upper and lower openings of the through hole 42, so that the trigger pin 37 can be prevented from slipping out of the through hole 42. This permits easy handling of the rocker arm shaft assembly 14A, thus achieving a more efficient assembly method of the rocker arm shaft assembly 14A relative to the cylinder head 2.

As described above, the variable valve-actuating mechanism 5 according to the exemplary embodiment of the present invention has the intake-side rocker arm 13 (or the exhaust-side rocker arm 17) disposed between the intake valve 6 (or the exhaust valve 7) of the engine 1 and the left and right first cams 15*a*, 16*a* and the left and right second cams 15*b*, 16*b* relative to the intake valve 6 and the intake-side rocker arm shaft 14 (or the exhaust-side rocker arm shaft 18) pivotally supporting the rocker arm 13 and being axially movable along the axial direction thereof, the rocker arm 13 (the rocker arm 17) axially sliding along the rocker arm shaft 14 (rocker arm shaft 18) according to the axial movement of the rocker arm shaft 14 (or the rocker arm shaft 18), thereby allowing the rocker arm 13 (the rocker arm 17) to selectively engage either one of the first cams 15*a*, 16*a* and the second cams 15*b*, 16*b* to change the operation of the intake valve 6 (exhaust valve 7). The variable valve-actuating mechanism 5 includes the trigger arm 33 engaging the rocker arm 13 to restrict the axial movement of the rocker arm 13; the trigger pin 37 releasing engagement of the trigger arm 33 according to an axial movement of the rocker arm shaft 14 so as to effect the axial movement of the rocker arm 13 at a predetermined timing; and the retention member (the rocker arm shaft 14) having the through hole 42 in which the trigger pin 37 is to be inserted and supporting the trigger pin 37 slidably in the inserting direction. The trigger pin 37 includes the upper and lower expanded portions 37*b*, 37*c* disposed on both sides in the inserting direction, the upper and lower expanded portions 37*b*, 37*c* preventing the sliding motion of the trigger pin 37 from exceeding a predetermined range relative to the retention member. Further, the upper and lower expanded portions 37*b*, 37*c* allow the trigger pin 37 to be integrally assembled in the retention member while being prevented from slipping out of position from the through hole 42.

According to the foregoing arrangements, the trigger pin 37 includes the upper and lower expanded portions 37*b*, 37*c* disposed on both sides in the inserting direction relative to the retention member (rocker arm shaft 14) and the trigger pin 37 is relatively movable only in the predetermined range relative to the retention member. This allows the trigger pin 37 to be integrally assembled in the retention member while being prevented from slipping out of position. As a result, in the subassembly (rocker arm shaft assembly 14A) that integrally assembles together, for example, the rocker arm shaft 14 (retention member), the rocker arm 13, and the trigger pin 37, there is no likelihood that the trigger pin 37 will slip out of the retention member, achieving an improved method of assembly of the subassembly in the engine main body.

Additionally, in the valve-actuating mechanism 5, the through hole 42 includes the circular hole portion 43*b* to be used during assembly of the trigger pin 37 and the slot portion 43*a* allowing the trigger pin 37 to be moved in the axial direction and holding the trigger pin 37 after the trigger pin 37 is inserted in the circular hole portion 43*b*; the circular hole portion 43*b* has the inside diameter r that is larger than the short side dimension t of the slot portion 43*a* extending orthogonally to the axial direction; the upper and lower expanded portions 37*b*, 37*c* include the large and small protrusion portions 38*b*, 38*c* protruding in the direction orthogonal to the axial direction relative to the pass-through portion 37*a* held in the through hole 42; and the large and small protrusion portions 38*b*, 38*c* have the longitudinal widths h1, h2 in the protruding direction that can pass through the circular hole portion 43*b* and are larger than the short side dimension t of the slot portion 43*a*.

According to the foregoing arrangements, the trigger pin 37 can be inserted into the through hole 42 by using the circular hole portion 43*b* and, after the trigger pin 37 is inserted in the through hole 42, the trigger pin 37 is moved into the slot portion 43*a*, which causes the upper and lower expanded portions 37*b*, 37*c* to be caught by the edge of the opening of the slot portion 43*a*, so that the trigger pin 37 can be locked in position. The trigger pin 37 can therefore be integrally assembled in the retention member through a simple structure, as described above.

Additionally, in the valve-actuating mechanism 5, the trigger pin 37 moves along the slot portion 43*a* in the axial direction during operation of the variable valve-actuating mechanism 5; and the circular hole portion 43*b* is disposed outside the slot portion 43*a* in the axial direction and outside the range of movement of the trigger pin 37 in the axial direction during the operation of the variable valve-actuating mechanism 5.

According to the foregoing arrangements, the circular hole portion 43*b* for assembling the trigger pin 37 is disposed at a position outside the range of movement of the trigger pin 37 during the operation of the variable valve-actuating mechanism 5. The trigger pin 37 will therefore never reach the circular hole portion 43*b* during the operation of the variable valve-actuating mechanism 5, so that the trigger pin 37 can be inhibited from, for example, being shaky, and reliable operation can be maintained.

Additionally, in the valve-actuating mechanism 5, the trigger pin 37 has the upper expanded portion 37*b* including the expanded portion 38*b* protruding relatively largely relative to the pass-through portion 37*a* and the lower expanded portion 37*c* including the small protrusion portion 38*c* protruding relatively small, disposed on both sides of the trigger pin 37 in the inserting direction; and the upper expanded portion 37*b* has the longitudinal width h1 in a direction orthogonal to the axial direction larger than the inside diameter r of the circular hole portion 43*b*.

According to the foregoing arrangements, when the trigger pin 37 is inserted in the circular hole portion 43*b* with the lower expanded portion 37*c* first in order to assemble the trigger pin 37 using the circular hole portion 43*b*, there is no likelihood that the trigger pin 37 will slip out of position through the circular hole portion 43*b*. The method of assembly of the subassembly can therefore be enhanced.

Additionally, in the valve-actuating mechanism 5, the expanded portion 38*b* is disposed to be continuous with the abutment portion (the apex portion 37*e*) abutting on the stopper member when engagement of the stopper member is to be released.

According to the foregoing arrangements, the expanded portion is disposed so as to be continuous with the abutment portion that abuts on the stopper member, which forms a structure that lets the abutment portion and the expanded portion reinforce each other.

Additionally, in the valve-actuating mechanism 5, portions in the large and small protrusion portions 38*b*, 38*c* of the trigger pin 37 facing the upper corner portions 42*a* of the through hole 42 include the groove portions 39 that inhibit contact with the upper corner portions 42*a*. This prevents the trigger pin 37 from contacting the upper corner portions 42*a* of the through hole 42, thereby ensuring smooth axial movements of the trigger pin 37 and inhibiting wear.

Additionally, in the valve-actuating mechanism 5, the groove portions 39 are formed into a concave shape to avoid the burrs B formed at the upper corner portions 42*a* of the through hole 42. This prevents contact of the trigger pin 37 with the burrs B to thereby ensure smooth motion.

Additionally, in the valve-actuating mechanism 5, the trigger pin 37 is molded using a mold and the groove portions 39 are integrally formed during the molding process. As compared with a case in which the upper corner portions 42*a* of the through hole 42 are subjected to, for example, rounding or chamfering or other form of machining, the molding process can form the groove portions 39 integrally with the trigger pin 37, thus achieving reduction in cost.

It should be understood that the present invention is not limited to the disclosed embodiment. The present invention may, for example, be applied to reciprocating engines of various types, including parallel multi-cylinder engines other than the four-cylinder type, V-type or horizontally opposed multi-cylinder engines, single-cylinder engines, and longitudinal engines having a crankshaft extending in the vehicle longitudinal direction. In addition, the retention member supporting the trigger pin 37 may be provided separately from the rocker arm shaft 14. Further, the circular hole portions 43*b* may be disposed on only either end side of the through hole 42, in which case the number of machining processes for the rocker arm shaft 14 can be reduced to achieve reduced processing cost.

Although the present invention has been described herein with respect to a number of specific illustrative embodiments, the foregoing description is intended to illustrate, rather than to limit the invention. Those skilled in the art will realize that many modifications of the illustrative embodiment could be made which would be operable. All such modifications, which are within the scope of the claims, are intended to be within the scope and spirit of the present invention.

What is claimed is:

1. In an internal combustion engine having a cylinder head, the improvement comprising a variable valve-actuating mechanism comprising:

a first camshaft and a second camshaft rotatably disposed in the cylinder head;

a rocker arm disposed between an engine valve and a corresponding cam on one of said camshafts on an intake-side or an exhaust-side of the internal combustion engine;

a rocker arm shaft pivotally supporting the rocker arm so as to be movable in an axial direction thereof, wherein the rocker arm may axially slide along the rocker arm shaft to selectively engage either a first cam or a second cam to change operation of the engine valve:

a stopper member for engaging the rocker arm to restrict an axial movement thereof;

a release member for releasing engagement of the stopper member so as to permit the axial movement of the rocker arm at a predetermined time; and a retention member having an insertion aperture formed therein for receiving the release member and slidably supporting the release member in the inserting direction;

wherein the release member includes a movement-restricting device disposed on both sides thereof in the inserting direction, the movement-restricting device operable to prevent a sliding motion of the release member from exceeding a predetermined range relative to the retention member;

and wherein the movement-restricting device allows the release member to be integrally assembled in the retention member so as to be restrained therein.

2. The variable valve-actuating mechanism according to claim 1, wherein:

the insertion aperture includes a circular hole portion to be used during assembly of the release member and a slot portion allowing the release member to be moved in the axial direction and holding the release member after the release member is inserted in the circular hole portion;

the circular hole portion has an inside diameter that is larger than a short side dimension of the slot portion extending orthogonally to the axial direction;

the movement-restricting device includes a protrusion portion protruding in a direction orthogonal to the axial direction relative to an insertion portion held in the insertion aperture;

and the protrusion portion has a width in the protruding direction that can pass through the circular hole portion and is larger than the short side dimension of the slot portion.

3. The variable valve-actuating mechanism according to claim 2, wherein:

the release member moves along the slot portion in the axial direction during operation of the variable valve-actuating mechanism; and the circular hole portion is disposed outside the slot portion in the axial direction and outside a range of movement of the release member in the axial direction during the operation of the variable valve-actuating mechanism.

4. The variable valve-actuating mechanism according to claim 3, wherein:

the release member has first movement-restricting device including an expanded portion, which is relatively large when compared to the inserted portion, and second movement-restricting device including a small protrusion portion, which is relatively small, disposed on both sides of the release member in the inserting direction; and the first movement-restricting device has a width, in a direction orthogonal to the axial direction, larger than the inside diameter of the circular hole portion.

5. The variable valve-actuating mechanism according to claim 4, wherein the expanded portion is disposed so as to be continuous with an abutment portion abutting on the stopper member when engagement of the stopper member is to be released.

6. The variable valve-actuating mechanism according to claim 2, wherein:

the release member has first movement-restricting device including an expanded portion, which is relatively large when compared to the inserted portion, and second movement-restricting device including a small protrusion portion, which is relatively small, disposed on both sides of the release member in the inserting direction; and the first movement-restricting device has a width, in a direction orthogonal to the axial direction, larger than the inside diameter of the circular hole portion.

7. The variable valve-actuating mechanism according to claim 6, wherein the expanded portion is disposed so as to be continuous with an abutment portion abutting on the stopper member when engagement of the stopper member is to be released.

8. The variable valve-actuating mechanism according to claim 2, wherein a portion of the protrusion portion of the release member facing a corner portion of the insertion aperture includes an escape portion inhibiting contact with the corner portion.

9. The variable valve-actuating mechanism according to claim 8, wherein the escape portion is formed in a concave shape.

10. The variable valve-actuating mechanism according to claim 9, wherein the release member is formed in a mold and the escape portion is integrally formed during molding thereof.

11. The variable valve-actuating mechanism according to claim 8, wherein the release member is formed in a mold and the escape portion is integrally formed during molding thereof.

12. An internal combustion engine with a variable valve-actuating mechanism, said engine comprising:

a cylinder head having a first camshaft and a second camshaft rotatably disposed therein;

an intake valve and an exhaust valve slidably disposed in said cylinder head;

a rocker arm disposed between an engine valve, which is either said intake valve or said exhaust valve, and a corresponding cam on one of said camshafts on an intake-side or an exhaust -side of the internal combustion engine;

a rocker arm shaft pivotally supporting the rocker arm so as to be movable in an axial direction thereof, wherein the rocker arm may axially slide along the rocker arm shaft to selectively engage either a first cam or a second cam to change operation of the engine valve:

a stopper member for engaging the rocker arm to restrict axial movement thereof;

a release member for releasing engagement of the stopper member so as to permit axial movement of the rocker arm at a predetermined time; and a retention member having an insertion aperture formed therein for receiving the release member and slidably supporting the release member in the inserting direction;

wherein the release member includes a movement-restricting device disposed on both sides thereof in the inserting direction, the movement-restricting device operable to prevent a sliding motion of the release member from exceeding a predetermined range relative to the retention member;

and wherein the movement-restricting device allows the release member to be integrally assembled in the retention member so as to be restrained therein.

13. The internal combustion engine according to claim 12, wherein:

the insertion aperture includes a circular hole portion to be used during assembly of the release member and a slot portion for allowing the release member to be moved in the axial direction and for holding the release member after the release member is inserted in the circular hole portion;

the circular hole portion has an inside diameter that is larger than a short side dimension of the slot portion extending orthogonally to the axial direction;

the movement-restricting device includes a protrusion portion protruding in a direction orthogonal to the axial direction relative to an insertion portion held in the insertion aperture;

and the protrusion portion has a width in the protruding direction that can pass through the circular hole portion and is larger than the short side dimension of the slot portion.

14. The internal combustion engine according to claim 13, wherein:

the release member moves along the slot portion in the axial direction during operation of the variable valve-actuating mechanism; and the circular hole portion is disposed outside the slot portion in the axial direction and outside a range of movement of the release member in the axial direction during the operation of the variable valve-actuating mechanism.

15. The internal combustion engine according to claim 13, wherein:

the release member has first movement-restricting device including an expanded portion, which is relatively large when compared to the inserted portion, and second movement-restricting device including a small protrusion portion, which is relatively small, disposed on both sides of the release member in the inserting direction; and the first movement-restricting device has a width, in a direction orthogonal to the axial direction, larger than the inside diameter of the circular hole portion.

16. The internal combustion engine according to claim 15, wherein the expanded portion is disposed so as to be continuous with an abutment portion abutting on the stopper member when engagement of the stopper member is to be released.

17. The internal combustion engine according to claim 16, wherein the release member is formed in a mold and the escape portion is integrally formed during molding thereof.

18. The internal combustion engine according to claim 13, wherein a portion of the protrusion portion of the release member facing a corner portion of the insertion aperture includes an escape portion inhibiting contact with the corner portion.

19. The internal combustion engine according to claim 18, wherein the escape portion is formed in a concave shape.

* * * * *